US006715483B2

(12) United States Patent
Erdmann et al.

(10) Patent No.: US 6,715,483 B2
(45) Date of Patent: Apr. 6, 2004

(54) TELESCOPIC LINKAGE FOR HOUSEHOLD APPLIANCES

(75) Inventors: Klaus Erdmann, Walzbachtal (DE); Hubert Giraud, Stutensee-Fr (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 59 days.

(21) Appl. No.: 10/093,233

(22) Filed: Mar. 7, 2002

(65) Prior Publication Data

US 2002/0153461 A1 Oct. 24, 2002

Related U.S. Application Data

(62) Division of application No. PCT/EP00/08714, filed on Sep. 6, 2000.

(30) Foreign Application Priority Data

Sep. 7, 1999 (EP) ..... 99117670

(51) Int. Cl.[7] ..... F24C 3/12
(52) U.S. Cl. ..... 126/42; 431/72; 74/25
(58) Field of Search ..... 126/42, 39 N; 431/153, 72; 74/25; 248/276.1; 137/625.25, 627.5

(56) References Cited

U.S. PATENT DOCUMENTS

| | | | | | |
|---|---|---|---|---|---|
| 2,292,735 | A | * | 8/1942 | Besocke | 126/42 |
| 3,200,807 | A | * | 8/1965 | Culligan | 126/42 |
| 5,059,852 | A | * | 10/1991 | Meury | 310/339 |
| 6,299,113 | B1 | * | 10/2001 | Yamashita et al. | 248/161 |

FOREIGN PATENT DOCUMENTS

| | | | | | |
|---|---|---|---|---|---|
| DE | 198 29 286 | A1 | * | 1/2000 | F24C/3/12 |
| EP | 0 718 745 | A2 | | 6/1996 | |
| EP | 1 278 015 | A2 | * | 1/2003 | F24C/3/12 |
| GB | 2 203 234 | A | | 10/1988 | |
| GB | 2 261 484 | A | * | 5/1993 | F24C/3/12 |

* cited by examiner

*Primary Examiner*—Josiah Cocks
(74) *Attorney, Agent, or Firm*—Laurence A. Greenberg; Werner H. Stemer; Gregory L. Mayback

(57) ABSTRACT

A telescopic linkage, in particular, for gas cooking points includes an arresting mechanism between two longitudinal telescopic bodies, one inserted inside the other in a longitudinal direction, optionally opened, by manual rotation at one linkage end, for changing the length of the telescopic linkage or for safeguarding against unauthorized or accidental switching on of a household appliance.

17 Claims, 3 Drawing Sheets

TELESCOPIC LINKAGE FOR HOUSEHOLD APPLIANCES

CROSS-REFERENCE TO RELATED APPLICATION

This application is a continuation of copending International Application PCT/EP00/08714, filed Sep. 6, 2000, which designated the United States.

BACKGROUND OF THE INVENTION

Field of the Invention

The invention relates to a telescopic linkage for household appliances for transmitting adjusting movements and adjusting forces in the longitudinal linkage direction and around this in the direction of rotation from one linkage end to the other.

The telescopic linkage serves for transmitting adjusting movements in the longitudinal linkage direction and around this in the direction of rotation from one linkage end to the other, and has two tubular and/or rod-like telescopic parts, referred herein as longitudinal telescopic bodies, which are inserted one inside the other in the longitudinal linkage direction.

A type of telescopic linkage is disclosed in European Patent Application EP 0 718 745 A2 and, in the document, the linkage connects the gas faucet of a gas cooking point to a manually actuable rotary knob (operating element) on the front of a gas cooker. By virtue of manually pushing in the rotary knob, the telescopic linkage can be displaced inwards and an ignition safety device can, thus, be activated. This opens an ignition-safety-device gas route of which the ignition flame keeps the ignition safety device in an unblocking position, in which the gas faucet can be rotated open and closed by way of the rotary knob. When the ignition-safety-device flame is extinguished, the ignition safety device passes into a blocking position, in which it shuts off the entire gas feed through the gas faucet, regardless of the rotary position of the rotary knob. By virtue of the telescopic linkage being rotated by way of the rotary knob, the gas faucet can be opened to a more or less pronounced extent to adjust the size of the gas cooking flames at the gas faucet. The gas-adjusting rotary range of the telescopic linkage, thus, also of the gas faucet, is limited to, for example, 210° by stops on the gas faucet. To adapt the length of the telescopic linkage to different construction or tolerance-induced dimensions between the gas faucet and a switching unit of the rotary knob, the two longitudinal telescopic bodies, which are plugged one inside the other in the longitudinal direction, can be fixed relative to one another in the longitudinal direction by an adjusting screw that is screwed transversally to the outer longitudinal telescopic body and can be braced against the inner longitudinal telescopic body. They have to be capable of being connected fixedly to one another in the longitudinal direction for the transmission of the adjusting force for the ignition safety device. For the transmission of torques, the outer telescopic body has a cross-sectional cross-shaped opening in the longitudinal direction and the inner telescopic body has a cross-shaped cross-section that fits into the cross-shaped opening. If, following the assembly of the gas cooker, it turns out that the telescopic length does not coincide precisely with the dimensions between the switching unit of the gas faucet and the rotary knob, then high-outlay removal of parts of the gas cooker and renewed adjustment of the telescopic length are subsequently necessary, which can only be done by a service engineer or fitter.

A further disadvantage of prior art gas cookers is the absence of a safeguard against unauthorized or accidental actuation of the rotary knob, e.g., during cleaning of the household appliance. Such actuation is also associated with the risk of gas being able to pass out in the unburned state or, during ignition, possibly resulting in a fire, for example, in the case of unauthorized operation by a child. Measures for safeguarding against unauthorized or accidental operation that are of straightforward construction and are inexpensive and straightforward to operate are also desirable in the case of electric household appliances such as, for example, electric cookers, ovens, automatic dishwashers, washing machines, and laundry dryers.

SUMMARY OF THE INVENTION

It is accordingly an object of the invention to provide a telescopic linkage for household appliances that overcomes the hereinafore-mentioned disadvantages of the heretofore-known devices of this general type and that constructs the telescopic linkage such that it can subsequently be adjusted to different lengths from outside the household appliance in which it is installed without there being any need for access to the telescopic linkage by dismantling the household appliance. The invention also is intended to configure a telescopic linkage that, by straightforward operation, can be switched over between an active and an inactive state to safeguard against unauthorized or accidental use of the relevant household appliance.

With the foregoing and other objects in view, there is provided, in accordance with the invention, a household appliance telescopic linkage including at least two longitudinal telescopic bodies including a first body and a second body each having a linkage end, the bodies defining a longitudinal linkage direction, the first body at least partially inserted inside the second body in the longitudinal linkage direction and rotatable in the second body at least in a rotation direction, the bodies transmitting adjusting movements and adjusting forces from the linkage end of the first body to the linkage end of the second body in the longitudinal linkage direction and around the longitudinal linkage direction in the rotation direction, the bodies displaceable relative to one another in the longitudinal linkage direction and arrestable with one another for joint longitudinal movement, the bodies rotatable relative to one another through an angle-of-rotation range about the longitudinal linkage axis between an axially arrested position in which the bodies are axially arrested with respect to one another and an axially released position in which the bodies are axially moveable with respect to one another, and due to the relative rotation, the bodies, at least in the axially arrested position, being additionally arrestable relative to one another in the rotation direction and releaseable from one another by rotation in a direction opposite the rotation direction.

The invention provides that the two longitudinal telescopic bodies can be rotated relative to one another, and an arresting mechanism can be actuated by rotation of the two longitudinal telescopic bodies relative to one another and releases the two longitudinal telescopic bodies in a first rotary-angle position, for displacement relative to one another in the longitudinal linkage direction, but connects the longitudinal telescopic bodies to one another such that they are longitudinally and rotationally fixed relative to one another, in a second rotary-angle position, for the transmission of the adjusting movements and of the adjusting forces in the longitudinal linkage direction and direction of rotation. The arresting mechanism has, for the rotationally fixed connection in the second rotary-angle position, an arresting device that at least initially counter a rotation of the two longitudinal telescopic bodies relative to one another from the second rotary-angle position in the direction of the first rotary-angle position by a resistance that can be overcome manually and is greater than the torque that can be transmitted by the telescopic linkage for the adjusting movements in a household appliance.

In accordance with a further feature of the invention, the bodies each have a coupling toothing formation with coupling teeth, the coupling teeth running transverse to the longitudinal linkage direction, and the coupling teeth of each of the bodies selectively engaged and disengaged with one another by rotation of the bodies.

In accordance with an added feature of the invention, there is provided an arresting mechanism connected to the bodies, a rotation of the bodies with respect to one another actuating the arresting mechanism, in a first rotary-angle position, to release the bodies for displacement relative to one another in the longitudinal linkage direction, and to longitudinally and rotationally fix the bodies relative to one another in a second rotary-angle position for transmission of the adjusting movements and of the adjusting forces in the longitudinal linkage direction and the rotation direction, the arresting mechanism having, for the rotationally fixed connection in the second rotary-angle position, an arresting device at least initially countering a rotation of the bodies relative to one another from the second rotary-angle position in a direction of the first rotary-angle position with a resistance to be manually overcome and greater than a torque to be transmitted by the telescopic linkage for the adjusting movements in the household appliance.

In accordance with an additional feature of the invention, the arresting mechanism has at least one blocking body, the blocking body is guided on the second body and moves transverse to the longitudinal linkage direction, the first body has a coupling toothing formation with coupling teeth having tooth gaps running transverse to the longitudinal linkage direction, the blocking body has a coupling toothing formation with coupling teeth having tooth gaps running transverse to the longitudinal linkage direction, the coupling toothing formation of the blocking body is disposed opposite the coupling toothing formation of the first body, the blocking body and the first body form a carry-along connection therebetween transferring torque movements of the first body to movements of the blocking body transverse to the longitudinal telescopic direction, and the carry-along connection engaging and disengaging the coupling toothing formation of the blocking body and the coupling toothing formation of the first body.

In accordance with yet another feature of the invention, there is provided at least one spring forcing the blocking body in a direction transverse to the longitudinal linkage direction towards the first body from a disengagement position of the coupling toothing formations into an engagement position of the coupling toothing formations.

In accordance with yet a further feature of the invention, the second body has a guide body, the blocking body is guided transverse to the longitudinal linkage direction on the guide body, the arresting mechanism has protrusions and cutouts, one of the protrusions and the cutouts is disposed on the blocking body and another of the protrusions and the cutouts is disposed on the guide body, one of the blocking body and the guide body having the cutouts has a sliding surface and the protrusions and the cutouts latch one inside another only in predetermined rotary-angle positions of the bodies, at least in the first rotary-angle position and the second rotary-angle position of the bodies, a manual twisting movement between the bodies is necessary for a subsequent unlatching operation of the bodies, and in an unlatched state of the bodies, the protrusions are braced against the sliding surface.

In accordance with yet an added feature of the invention, between the first rotary-angle position and the second rotary-angle position is an intermediate rotary-angle position, the coupling toothing formations are disengaged in the intermediate rotary-angle position, in the intermediate rotary-angle position, the bodies are displaceable relative to one another in the longitudinal linkage direction for a length adjustment of the telescopic linkage, a protrusion is disposed between the blocking body and the guide body, the protrusion projecting from one of the blocking body and the guide body to another of the blocking body and the guide body, and when the bodies are rotated between the second rotary-angle position, in which the bodies are connected to one another for joint longitudinal movement, and the intermediate rotary-angle position, the protrusion is freely moveable, runs onto a mating surface of the one of the blocking body and the guide body not having the protrusion with further rotary movement from the intermediate rotary-angle position in a direction of the first rotary-angle position, and produces a frictional resistance counteracting such rotary movement of the bodies.

In accordance with yet an additional feature of the invention, there is provided a slot having a slot edge is formed in the one of the blocking body and the guide body having the mating surface, the protrusion projecting into the slot over a movement path corresponding to a rotary angle between the second rotary-angle position and the intermediate rotary-angle position, and the protrusion running over the slot edge onto the mating surface when rotation occurs beyond the intermediate rotary position in a direction of the first rotary-angle position.

In accordance with again another feature of the invention, the protrusions have a given height, between the guide body and the blocking body is an interspace smaller than the height of the protrusions, and the protrusions are clamped in between the guide body and the blocking body during relative displacement of the guide body and the blocking body to one another when the bodies are rotated relative to one another.

In accordance with again a further feature of the invention, the blocking body is two blocking bodies disposed opposite one another on sides of the first body.

In accordance with again an added feature of the invention, the spring has a spring force sufficiently large enough to rotate, through the blocking body, the bodies relative to one another from the intermediate rotary-angle position into the second rotary-angle position.

In accordance with again an additional feature of the invention, the second rotary-angle position is a locking position.

In accordance with still another feature of the invention, the blocking body is two blocking bodies disposed on the first body and the spring is a spring clip encompassing the two blocking bodies and forcing the two blocking bodies toward one another in a direction of the first body.

In accordance with still a further feature of the invention, the spring and the protrusions each having a movement-blocking force sufficiently large in each case to withstand rotary torques between the bodies at least as large as torques for transmitting the adjusting movements and the adjusting forces of the telescopic linkage in the rotation direction.

With the objects of the invention in view, in a household appliance having a manual operating element and a functional part, there is also provided a telescopic linkage for connecting the manual operating element to the functional part, the telescopic linkage including at least two longitudinal telescopic bodies including a first body and a second body each having a linkage end, the bodies defining a longitudinal linkage direction, the first body at least partially inserted inside the second body in the longitudinal linkage direction and rotatable in the second body at least in a rotation direction, the bodies transmitting adjusting movements and adjusting forces from the linkage end of the first body to the linkage end of the second body in the longitudinal linkage direction and around the longitudinal linkage direction in the rotation direction, the bodies displaceable relative to one another in the longitudinal linkage direction and arrestable with one another for joint longitudinal movement, the bodies rotatable relative to one another through an angle-of-rotation range about the longitudinal linkage axis between an axially arrested position in which the bodies are axially arrested with respect to one another and an axially released position in which the bodies are axially moveable with respect to one another, and due to the relative rotation, the bodies, at least in the axially arrested position, being additionally arrestable relative to one another in the rotation direction and releaseable from one another by rotation in a direction opposite the rotation direction.

The invention has the advantage, on one hand, that the telescopic linkage, by a manual actuating element at one end, can be displaced in the longitudinal linkage direction and can be rotated around the longitudinal linkage direction, and can transmit axial forces and torque in the process, but, on the other hand, by the operating element, the two longitudinal telescopic bodies can be rotated relative to one another and can then be displaced relative to one another in the longitudinal telescopic direction for the adjustment of different telescopic lengths. The configuration also gives a safeguard against unauthorized (child proofing) or accidental switching on of the household appliance, for example, during cleaning of the front of the household appliance.

In accordance with a concomitant feature of the invention, the appliance has a cooking point with a gas faucet, an ignition safety device, and the telescopic linkage actuates the ignition safety device through the operating element in the longitudinal linkage direction and in the rotation direction.

Other features that are considered as characteristic for the invention are set forth in the appended claims.

Although the invention is illustrated and described herein as embodied in a telescopic linkage for household appliances, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following by description of specific embodiments when read in connection with the accompanying drawings.

DESCRIPTION OF THE PREFERRED EMBODIMENTS

Figure 1:
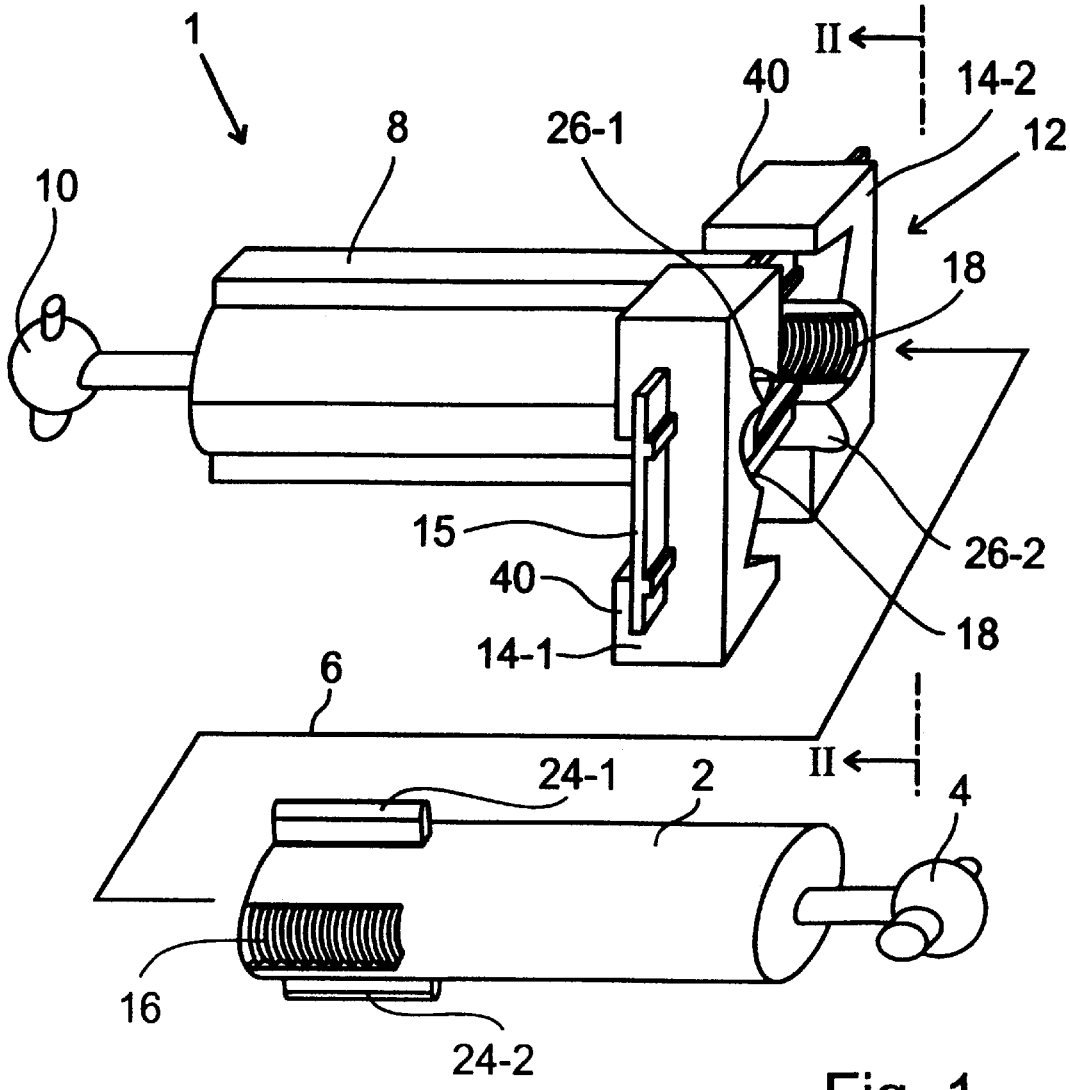
FIG. 1 is a perspective, exploded view of a telescopic linkage according to the invention.

Referring now to the figures of the drawings in detail and first, particularly to FIG. 1 thereof, there is shown a telescopic linkage 1 having an inner longitudinal telescopic body 2 that has a linkage end 4 and can be inserted longitudinally, along an arrow 6, into an outer longitudinal telescopic body 8, which has the other linkage end 10. The two longitudinal telescopic bodies 2 and 8, one inside the other, can be displaced relative to one another in the longitudinal linkage direction and can be rotated relative to one another.

Figure 2:
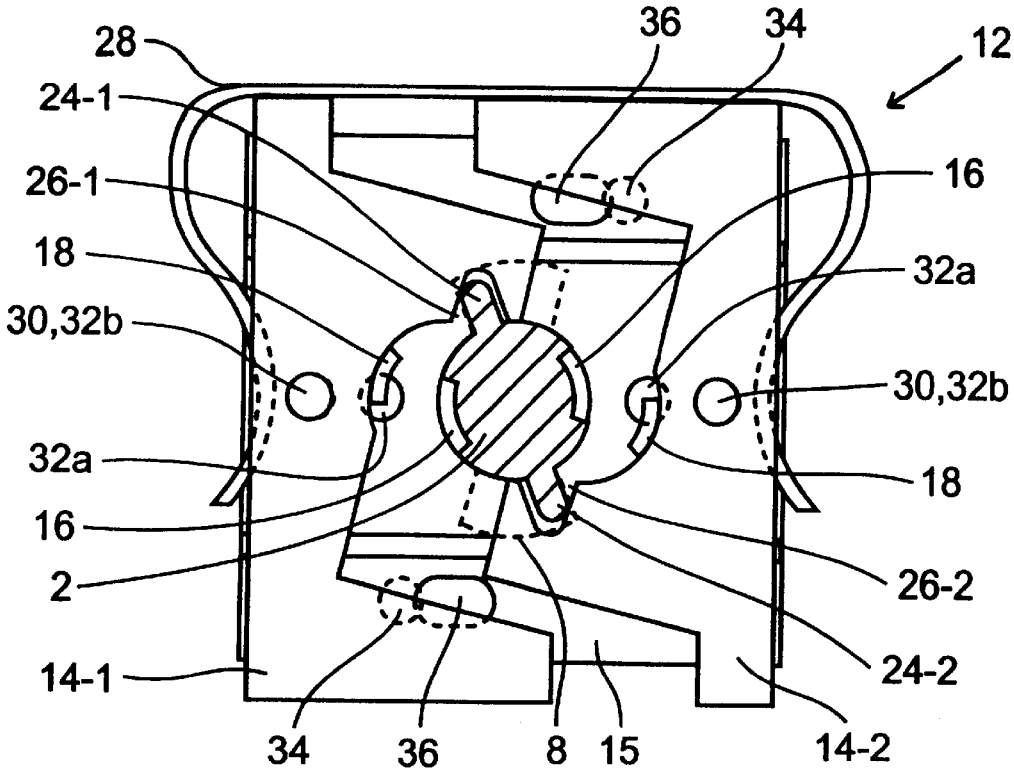
FIG. 2 is a cross-sectional view of the linkage of FIG. 1 along plane II—II in a first rotary-angle position of the two longitudinal telescopic bodies relative to one another, together with an arresting mechanism in a fully open state for the installation and removal of the two bodies.
Figure 4:
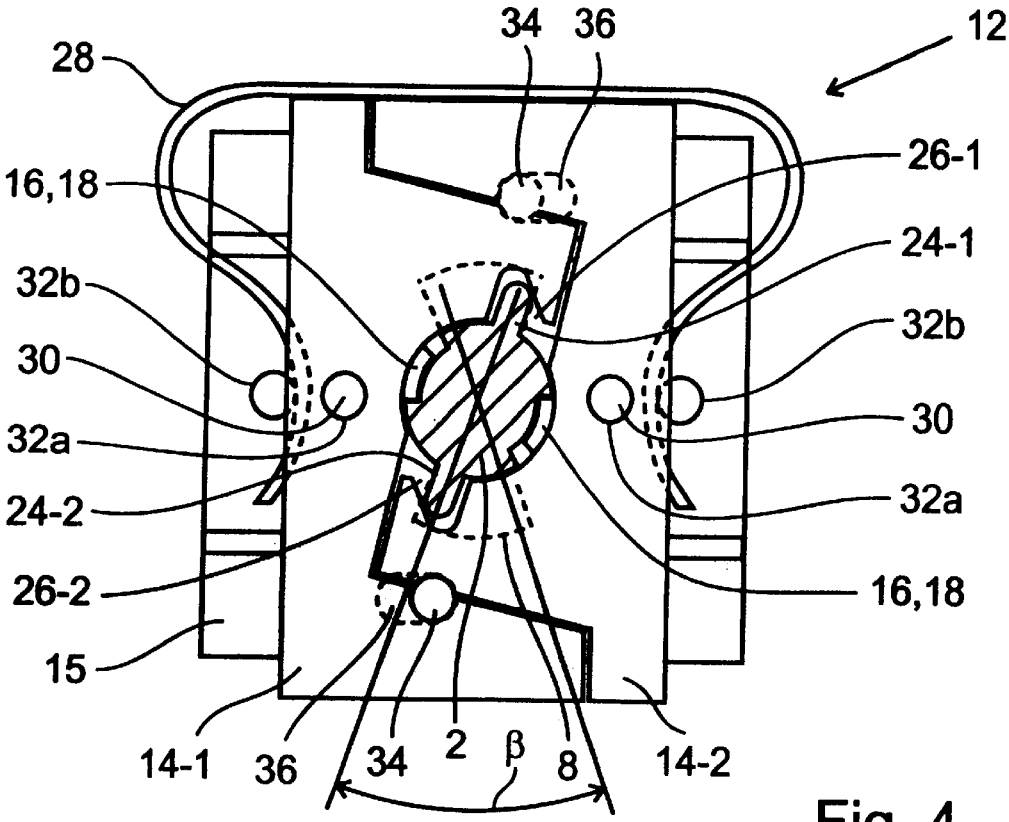
FIG. 4 is a cross-sectional view of the linkage of FIG. 2 in which the two longitudinal telescopic bodies are in a second rotary-angle position, in which they are coupled axially to one another by the closed arresting mechanism and are not displaceable relative to one another in the longitudinal direction.

Provided at the mutually facing ends of the two longitudinal telescopic bodies 2 and 8 is an arresting mechanism 12 that, by virtue of the two longitudinal telescopic bodies 2 and 8 being rotated relative to one another, can be adjusted between an open state in a first rotary-angle position (displacement position) illustrated in FIG. 2, and a closed state in a second rotary-angle position (blocking position) illustrated in FIG. 4.

The arresting mechanism 12, in the closed state of FIG. 4, connects the two longitudinal telescopic bodies 2 and 8, in the second rotary-angle position, to one another for the joint simultaneous transmission of movements and forces in the longitudinal linkage direction and in the direction of rotation, whereas, in the open state, in the first rotary-angle position of FIG. 2, it releases the two longitudinal telescopic bodies 2 and 8 for longitudinal displacements relative to one another. The arresting mechanism 12, in the closed state of FIG. 4, also connects the two longitudinal telescopic bodies 2 and 8, in the second rotary-angle position, for the joint transmission of rotary movements and torques, although the rotary connection can be released by the two longitudinal telescopic bodies 2 and 8 being subjected to an increased manual rotary torque in the direction from the second to the first rotary-angle position (FIGS. 3 and 4) as long as the torque is considerably larger than a torque that can be transmitted by the telescopic linkage 2 for adjusting movements in a household appliance.

The arresting mechanism 12 has at least one but preferably two to clamping jaws or blocking bodies 14-1 and 14-2 that are guided such that they can be moved transversely to the longitudinal linkage direction on a guide body 15 that is fastened at the inner end of the outer longitudinal telescopic body 8 or is integral therewith. The guide body 15 is preferably a guide plate that extends at right angles to the longitudinal linkage direction and is encompassed by the blocking bodies 14-1, 14-2.

The inner longitudinal telescopic body 2 has, on its outer circumference, a coupling toothing formation 16 with circumferentially extending coupling teeth and tooth gaps located therebetween. On their insides directed toward the coupling toothing formation 16, the two blocking bodies 14-1 and 14-2 have a matching coupling toothing formation 18 that, by displacement of the blocking bodies 14-1 and 14-2 on the guide body 15 at right angles to the longitudinal linkage direction, can optionally be engaged with, or disengaged from, the coupling toothing formation 16 of the inner longitudinal telescopic body 2.

For such a purpose, the inner longitudinal telescopic body 2 is provided, for each blocking body 14-1 and 14-2, with a respective longitudinally extending carry-along rib 24-1, 24-2, these ribs engaging radially in respective carry-along grooves 26-1 and 26-2 that are formed on the inside of the blocking bodies 14-1 and 14-2 and extend in the longitudinal direction. They are automatically engaged with one another when the two longitudinal telescopic bodies 2 and 8 are positioned one inside the other in the longitudinal direction.

FIG. 4 shows the rotary-angle range β through which the two longitudinal telescopic bodies 2 and 8 can be rotated relative to one another between the first rotary-angle position of FIG. 2 and the second rotary angle position of FIG. 4, in order to move the arresting mechanism 12, transversely to the longitudinal linkage direction, between the open position of FIG. 2 and the closed position of FIG. 4. In the open position of FIG. 2, the coupling toothing formations 16 and 18 are disengaged, while they engage with one another in the closed position of FIG. 4. It is, thus, possible for the two longitudinal telescopic bodies 2 and 8 to be displaced relative to one another in the longitudinal direction in the open position of FIG. 2, but not in the closed position of FIG. 4.

The two blocking bodies 14-1 and 14-2 are forced from the open position of FIG. 2 into the closed position of FIG. 4 by a spring clip 28 that spans them. To move the blocking bodies from the closed position into the open position, it is, thus, necessary, when the two longitudinal telescopic bodies 2 and 8 are rotated manually from the second rotary-angle position of FIG. 4 into the first rotary-angle position of FIG. 1, for the spring force of the spring clip 28 to be overcome manually.

In the closed position of the arresting mechanism 12 of FIG. 4, the two longitudinal telescopic bodies 2 and 8 are connected rigidly to one another in the longitudinal direction by the coupling toothing formations 16, 18 for the transmission of longitudinal movements and longitudinal forces. Moreover, it is also possible for rotary movements and torques to be transmitted between the two longitudinal telescopic bodies 2 and 8 without the latter being rotated relative to one another as long as the torque that is to be transmitted is no larger than the retaining torque that connects the longitudinal telescopic bodies to one another and is produced by the clamping action of the spring clip 28.

To increase the rotationally fixed connection and, thus, to increase the transmittable torque between the two longitudinal telescopic bodies 2 and 8, hemispherical first elevations 30 (protrusions) that project in the direction of the guide body 15 are formed in the blocking bodies 14-1 and 14-2, and these elevations, in the closed position of the arresting mechanism 12 shown in FIG. 4 (second rotary-angle position of the longitudinal telescopic bodies 2 and 8 relative to one another), latch into bores 32*a* of the guide body 15 and can only be unlatched again by an increased manual actuating force, for rotating the two longitudinal telescopic bodies 2 and 8 from the closed position of FIG. 4 in the direction of the open position of FIG. 2, counter to a clamping force between the two blocking bodies 14-1 and 14-2, on one hand, and the guide body 15, on the other hand.

Furthermore, second bores 32*b* that are located further to the outside, at a distance from the first bores 32*a*, are formed in the guide body 15 at the locations where the hemispherical elevations 30 are located in the open position of the arresting mechanism of FIG. 2, when the longitudinal telescopic bodies 2 and 8 are located in their first rotary-angle position. The blocking action of the elevations 30 in these further bores 32*b* is greater than the spring force of the spring clip 28, with the result that, rather than the spring clip 28 being able to move the blocking bodies 14-1 and 14-2 from the open position of FIG. 2 into the closed position of FIG. 4, it is necessary, for such a purpose, for the two longitudinal telescopic bodies 2 and 8 to be subjected to an additional manual rotary force. The configuration makes it possible for the longitudinal telescopic bodies 2, 8 to be installed and removed in the open position of FIG. 2 without any manual force being necessary for holding the blocking bodies 2, 8 in their open position. The open position of FIG. 2 is envisaged, in particular, for installation purposes.

Figure 3:
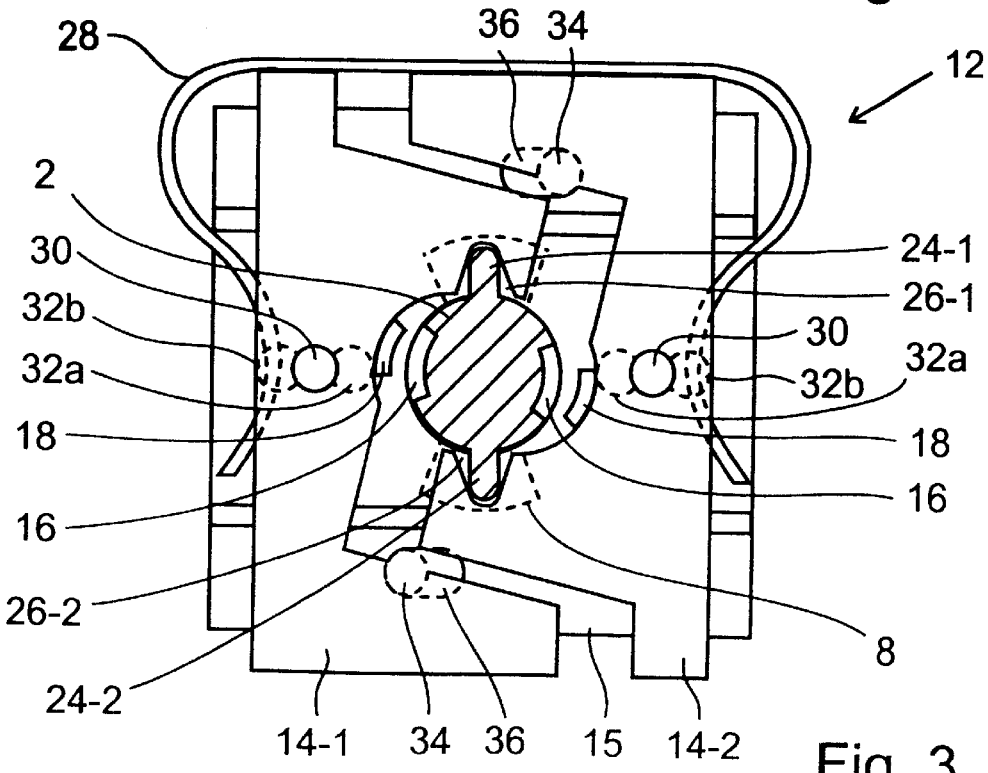
FIG. 3 is a cross-sectional view of the linkage of FIG. 2 in which the two longitudinal telescopic bodies are in an intermediate, preferably central, position, in which they are rotated relative to one another and the arresting mechanism is likewise in an intermediate position, in which the two bodies can still be displaced relative to one another in the longitudinal direction.

The intermediate position or central position illustrated in FIG. 3 is envisaged for axial displacements and adjustments of the two longitudinal telescopic bodies 2 and 8 relative to one another, in the state in which they are installed in a household appliance, by way of a manual operating element at one linkage end 4 or the other 10, in which position the parts are located in an intermediate position between the two positions of FIGS. 2 and 4 and that is likewise an open position of the arresting mechanism 12, in which the coupling toothing formations 16 and 18 are disengaged and the two longitudinal telescopic bodies 2 and 8 can, thus, be adjusted relative to one another in the longitudinal direction.

Hemispherical second elevations 34 (protrusions) that project in the direction of the guide body 15 are formed in the two blocking bodies 14-1 and 14-2 and, over the movement path of the blocking bodies 14-1 and 14-2 from the closed position in FIG. 4, in the direction of the open position, as far as the intermediate position of FIG. 3, move in slots 36 of the guide body 15 and then run onto the guide body 15 at a slot border. Consequently, for the two blocking bodies 14-1 and 14-2 to be moved further from the intermediate position of FIG. 3 to the open position in FIG. 2, an increased manual rotary force between the two longitudinal telescopic bodies 2 and 8 is necessary in order to overcome the friction of the second elevation 34 on the slot edge and then on an adjacent surface of the guide body 15. A user is, thus, aware when the intermediate position of FIG. 3 is exceeded in the direction of the open position of FIG. 2. In the case of the intermediate position of FIG. 3, the first elevations 30 are braced against the guide body 15 at a location that is located between the two bores 32*a* and 32*b*, these being associated with the end positions of FIGS. 2 and 4. The spring clip 28 has such a pronounced clamping-in force that, without any additional manual help, it can force the blocking bodies 14-1 and 14-2 back from the intermediate position of FIG. 3 into the blocking position of FIG. 4 and can, thus, rotate the two longitudinal telescopic bodies 2 and 8 from the intermediate position of FIG. 3 into the second rotary-angle position, shown in FIG. 4, upon removal of the manual rotary force from the telescopic linkage, which force is necessary to rotate the telescopic linkage from the second rotary-angle position of FIG. 4 (closed position of the arresting mechanism) into the intermediate position of FIG. 3 counter to the spring force of the spring clip 28.

Because, in the open position of FIG. 2 and the intermediate position of FIG. 3, which is likewise an open position, the telescopic linkage cannot transmit any movements or forces in the longitudinal direction, this position may be used as a position for safeguarding against unauthorized and accidental switching on of an appliance. An appliance can only be actuated or switched on, by axial movement and force transmission of the telescopic linkage, if the arresting mechanism is in the closed position, in other words, the second rotary-angle position of FIG. 4.

The hemispherical second elevations 34, which engage in the slots 36, are formed on the rear side of the guide body 15, in encompassing sections 40 of the blocking bodies 14-1 and 14-2, which can be seen in FIG. 1. Instead of bores and slots 32*a*, 32*b* and 34, it is also possible for depressions or other types of cutout or run-on edges, or run-on surfaces to be formed on the guide body 15, it being possible for the hemispherical or otherwise shaped elevations 30 and/or 34 to run onto the borders thereof in order to produce a "braking action " or "inhibiting action".

Figure 5:
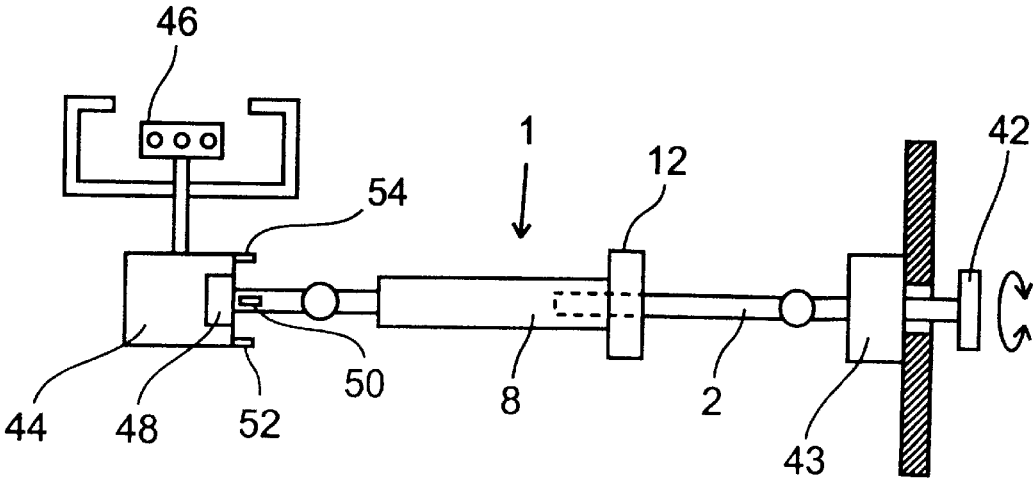
FIG. 5 is a partially cross-sectional diagrammatic side view of the linkage according FIGS. 1 to 4 installed in a household appliance for transmitting axial movements and rotary movements as well as axial forces and torques between a manual operating element and a functional part of a household appliance, for example, a gas faucet and an ignition safety device of a gas cooking point.

FIG. 5 schematically shows a rotary knob 42 of a rotary and press switch 43 that is located on the front of a gas cooker and is connected to a gas faucet 44 of a gas cooking point 46 by the telescopic linkage 1. By manually pressing in the telescopic linkage 1 by way of the operating element 42, it is possible to activate an ignition safety device 48 on the gas faucet for the purpose of opening the gas throughflow. As soon as a thermocouple of the ignition safety device 48 has been made warm enough by the gas flame in order to keep the gas route open, it is possible to release the manual pressing-in force and the size of the gas flame can be adjusted by rotating the gas faucet by the operating element 42 through the telescopic linkage 1.

The telescopic linkage 1 has a stop 50 by which it is possible to adjust the telescopic linkage 1, for the adjustment of the gas faucet, and, thus, of the gas flame, between two stops 52 and 54 of the gas faucet 44 over an adjusting rotary range of, for example, 20520 . By subjecting the operating element 42 to an increased manual rotary force in one direction of rotation or the other, toward one stop 52 or the other 54, it is possible by way of the operating element 42, in one direction of rotation or the other for the arresting mechanism 12 to be opened or closed and, in the open state, for the two longitudinal telescopic bodies 2 and 8 to be adjusted relative to one another in the longitudinal direction, as has been described above.

The following text describes use of an exemplary embodiment according to the invention.

In the closed state of the arresting mechanism 12, the two blocking bodies 14-1 and 14-2 (blocking jaws) encompass the inner longitudinal telescopic body 2 and the coupling toothing formations 16, 18 constitute a form-fitting connection, as seen in the longitudinal telescopic direction, between the inner longitudinal telescopic body 2 and the outer longitudinal telescopic body 8. See FIG. 4. The insides of the two blocking bodies 14-1 and 14-2 are shaped to correspond to the inner longitudinal telescopic body 2. The blocking body 14-1 and 14-2 are moved in the transverse linkage direction between the open positions in FIGS. 2 and 3 and the closed position in FIG. 4, e.g., diametrically in relation to the longitudinal linkage direction, by the carry-along ribs 24-1 and 24-2 that belong to the inner longitudinal telescopic body 2 and engage in the respective carry-along groove 26-1, 26-2 of the blocking bodies 14-1, 14-2. Depending on the direction of rotation between the two longitudinal telescopic bodies 2 and 8, the coupling toothing formation 18 of the two blocking bodies 14-1 and 14-2 engages in the coupling toothing formation 16 of the inner longitudinal telescopic body 2 (FIG. 4) or is separated therefrom (FIGS. 2 and 3).

To fix these different states of the blocking bodies 14-1 and 14-2, they are provided with the latches 30 and 34 in the form of hemispherical protrusions or in some other form. These latches 30, 34 interact with corresponding mating latches that are provided on the guide body 15 in the form of bores 32*a*, 32*b* and the slots 36 or in some other form, for example, in the form of depressions, end edges, cam surfaces, and the like. The position and form of these latches are selected such that the three states illustrated in FIGS. 2, 3 and 4 can be adjusted in a defined manner.

In the case of the closed state of the arresting mechanism 12, which is shown in FIG. 4, the second elevation 34 latches in the slot 36 and the first elevations 30 latch in the bores 32*a*, which, relative to the other bores 32*b*, are located more closely, in the radial direction, to the center longitudinal axis of the two longitudinal telescopic bodies 2 and 8. The configuration ensures, in addition to the spring force of the spring clip 28, that the interlocking of the coupling toothing formations 16 and 18 does not open. Both the latches in the form of the first elevations 30 and the bores 32*a* and 32*b* associated with them and the spring clip 28 are configured such that, in the event of one of these two systems failing, the closed state of the arresting mechanism 12, which is shown in FIG. 4, is maintained for the purpose of transmitting forces and movements in the longitudinal linkage direction and in the direction of rotation thereof. The interlocking 16, 18 must not open accidentally.

To pass from the closed position of FIG. 4 into the central position of the FIG. 3, the inner longitudinal telescopic body 2 has to be rotated through, for example, 20° in the counterclockwise direction relative to the outer longitudinal telescopic body 8. For such a purpose, it is necessary first of all for the operating element or the rotary knob 42 of the gas faucet 44, and, thus, the entire telescopic linkage, to be rotated through, for example, 205° in a counterclockwise direction to the "low position" (low flame setting), until one gas-faucet stop 52 has been reached. Only then is the rotation of the two longitudinal telescopic bodies 2 and 8 relative to one another possible. In the case of such a relative rotation, the first elevation 30 is lifted out of the first bore 32*a* while the second elevation 34 is displaced in the slot 36. The movement produces a pressure point that has to be overcome when the interlocking 16, 18 is released. During normal use of the cooking point 46, the user is, thus, aware that the stop 52 has been reached, and accidental opening of the locking of the telescopic linkage is ruled out.

The above-mentioned pressure point is only overcome if it becomes necessary for the length of the telescopic linkage to be adjusted. In such a case, the inner longitudinal telescopic body 2 is rotated relative to the outer longitudinal telescopic body 8 manually, by the rotary knob 42, counter to the spring force of the spring clip 28 and it has to be held manually in the rotary position counter to the spring force. The telescopic linkage adjusts itself automatically to the correct length, by mechanical stressing between the gas faucet 44 and the switch unit 43 of the rotary knob 42, as soon as the interlocking of the coupling toothing formation 16, 18 has been released. When the rotary knob 42 is released manually, the arresting mechanism 12 springs back automatically again, by virtue of the spring force of the spring clip 28, into its starting position of FIG. 4.

For installation and, subsequently, for possible removal purposes, it has to be ensured that the arresting mechanism can be fully opened and then no longer has to be held open by hand. FIG. 2 shows such a "fully open position". For such a purpose, it is possible for the inner longitudinal telescopic body 2 to be rotated through a further, for example, 20° (through a total of 40°) in a counterclockwise direction relative to the outer longitudinal telescopic body 8. In such a case, the second elevation 34 of the blocking body 14-1 and 14-2 springs out of the slot 36 and the first elevation 30 latches into the board 32*b*, which is located further to the outside in the radial direction. Such latching cannot be overcome by the spring force of the spring clip 28; rather, an additional manual force on the rotary knob 42 is required.

For the arresting mechanism to be closed again from the open state of FIG. 2, the rotary knob 42, and, thus, the entire telescopic linkage, has to be rotated back through the abovementioned 205° in the clockwise direction. When the telescopic linkage then reaches the other stop 54 on the gas faucet 44, the latching is released when the rotary knob 42 continues to be rotated back through a further 40° from "zero". The second elevation 34 of the blocking bodies 14-1 and 14-2 slides into the slot 36 and the first elevation 30 is released from the radially outer bore 32*b* and then latches into the bore 32*a*, which is located further toward the inside in relation to the outer bore 32*b*. In such a case, the arresting mechanism springs back into the closed state of FIG. 4. The telescopic linkage is, thus, arrested again at a fixed length.

In the open state of the arresting mechanism 12, as is shown in FIG. 3 and also in FIG. 2, it is not possible for the ignition safety device, and, thus, the gas outlet at the gas faucet 44, to be switched on because it is not possible to transmit an axial force from the rotary knob 42 to the gas faucet 44 and the ignition safety device thereof.

The spring clip 28 has the task of subjecting the coupling toothing formations 16, 18 to a continuous encompassing pressure of the blocking bodies 14-1 and 14-2, and, thus, of ensuring a reliable form fit. The spring clip 28 may be a wire spring. It is likewise possible to use other spring configurations. It is also possible for the springs to be produced integrally with the blocking bodies 14-1 and 14-2, in particular, if the latter are of plastic. Plastic, however, cannot be used in hot regions of cookers. It is, thus, the case in a gas cooker or electric cooker that the telescopic linkage, including the guide body 15 and the blocking bodies 14-1 and 14-2, will be of metal in each case.

So that the two longitudinal telescopic bodies 2 and 8 cannot slide apart from one another to the full extent, it is expedient for the sliding to be prevented by a stop formed between them. The outer longitudinal telescopic body 8 and the guide body 15 disposed at its front end (the guide body 15 being in the form of a guide plate provided with guide ribs or in some other form) may be formed together from a single material body. The outer longitudinal telescopic body 8 may be a tube and the inner longitudinal body 2 may be a rod.

We claim:

1. A household appliance telescopic linkage, comprising:

at least two longitudinal telescopic bodies including a first body and a second body each having a linkage end, said bodies defining a longitudinal linkage direction;

said first body at least partially inserted inside said second body in said longitudinal linkage direction and rotatable in said second body at least in a rotation direction;

said bodies transmitting adjusting movements and adjusting forces from said linkage end of said first body to said linkage end of said second body in said longitudinal linkage direction and around said longitudinal linkage direction in said rotation direction;

said bodies displaceable relative to one another in said longitudinal linkage direction and arrestable with one another for joint longitudinal movement;

said bodies rotatable relative to one another through an angle-of-rotation range about said longitudinal linkage axis between:

an axially arrested position in which said bodies are axially arrested with respect to one another; and an axially released position in which said bodies are axially moveable with respect to one another; and due to the relative rotation, said bodies, at least in said axially arrested position, being additionally arrestable relative to one another in said rotation direction and releaseable from one another by rotation in a direction opposite said rotation direction.

2. The telescopic linkage according to claim 1, wherein said bodies each have a coupling toothing formation with coupling teeth;

said coupling teeth running transverse to said longitudinal linkage direction; and said coupling teeth of each of said bodies selectively engaged and disengaged with one another by rotation of said bodies.

3. The telescopic linkage according to claim 1, including:

an arresting mechanism connected to said bodies;

a rotation of said bodies with respect to one another actuating said arresting mechanism:

in a first rotary-angle position, to release said bodies for displacement relative to one another in said longitudinal linkage direction; and to longitudinally and rotationally fix said bodies relative to one another in a second rotary-angle position for transmission of the adjusting movements and of the adjusting forces in said longitudinal linkage direction and said rotation direction;

said arresting mechanism having, for said rotationally fixed connection in said second rotary-angle position, an arresting device at least initially countering a rotation of said bodies relative to one another from said second rotary-angle position in a direction of said first rotary-angle position with a resistance to be manually overcome and greater than a torque to be transmitted by the telescopic linkage for the adjusting movements in the household appliance.

4. The telescopic linkage according to claim 3, wherein:

said arresting mechanism has at least one blocking body;

said blocking body is guided on said second body and moves transverse to said longitudinal linkage direction;

said first body has a coupling toothing formation with coupling teeth having tooth gaps running transverse to said longitudinal linkage direction;

said blocking body has a coupling toothing formation with coupling teeth having tooth gaps running transverse to said longitudinal linkage direction;

said coupling toothing formation of said blocking body is disposed opposite said coupling toothing formation of said first body;

said blocking body and said first body form a carry-along connection therebetween transferring torque movements of said first body to movements of said blocking body transverse to said longitudinal telescopic direction; and said carry-along connection engaging and disengaging said coupling toothing formation of said blocking body and said coupling toothing formation of said first body.

5. The telescopic linkage according to claim 4, including at least one spring forcing said blocking body in a direction transverse to said longitudinal linkage direction towards said first body from a disengagement position of said coupling toothing formations into an engagement position of said coupling toothing formations.

6. The telescopic linkage according to claim 4, wherein:

said second body has a guide body;

said blocking body is guided transverse to said longitudinal linkage direction on said guide body;

said arresting mechanism has protrusions and cutouts;

one of said protrusions and said cutouts is disposed on said blocking body and another of said protrusions and said cutouts is disposed on said guide body;

one of said blocking body and said guide body having said cutouts has a sliding surface; and said protrusions and said cutouts:

latch one inside another only in predetermined rotary-angle positions of said bodies; and at least in said first rotary-angle position and said second rotary-angle position of said bodies, a manual twisting movement between said bodies is necessary for a subsequent unlatching operation of said bodies; and in an unlatched state of said bodies, said protrusions are braced against said sliding surface.

7. The telescopic linkage according to claim 6, wherein:

between said first rotary-angle position and said second rotary-angle position is an intermediate rotary-angle position;

said coupling toothing formations are disengaged in said intermediate rotary-angle position;

in said intermediate rotary-angle position, said bodies are displaceable relative to one another in said longitudinal linkage direction for a length adjustment of the telescopic linkage;

a protrusion is disposed between said blocking body and said guide body, said protrusion projecting from one of said blocking body and said guide body to another of said blocking body and said guide body; and when said bodies are rotated between said second rotary-angle position, in which said bodies are connected to one another for joint longitudinal movement, and said intermediate rotary-angle position, said protrusion is freely moveable, runs onto a mating surface of said one of said blocking body and said guide body not having said protrusion with further rotary movement from said intermediate rotary-angle position in a direction of said first rotary-angle position, and produces a frictional resistance counteracting such rotary movement of said bodies.

8. The telescopic linkage according to claim 7, including:

a slot having a slot edge is formed in said one of said blocking body and said guide body having said mating surface;

said protrusion projecting into said slot over a movement path corresponding to a rotary angle between said second rotary-angle position and said intermediate rotary-angle position; and said protrusion running over said slot edge onto said mating surface when rotation occurs beyond said intermediate rotary position in a direction of said first rotary-angle position.

9. The telescopic linkage according to claim 6, wherein:

said protrusions have a given height;

between said guide body and said blocking body is an interspace smaller than said height of said protrusions; and said protrusions are clamped in between said guide body and said blocking body during relative displacement of said guide body and said blocking body to one another when said bodies are rotated relative to one another.

10. The telescopic linkage according to claim 4, wherein said blocking body is two blocking bodies disposed opposite one another on sides of said first body.

11. The telescopic linkage according to claim 5, wherein said spring has a spring force sufficiently large enough to rotate, through said blocking body, said bodies relative to one another from said intermediate rotary-angle position into said second rotary-angle position.

12. The telescopic linkage according to claim 11, wherein said second rotary-angle position is a locking position.

13. The telescopic linkage according to claim 5, wherein:

said blocking body is two blocking bodies disposed on said first body; and said spring is a spring clip encompassing said two blocking bodies and forcing said two blocking bodies toward one another in a direction of said first body.

14. The telescopic linkage according to claim 6, including:

at least one spring forcing said blocking body in a direction transverse to said longitudinal linkage direction towards said first body from a disengagement position of said coupling toothing formations into an engagement position of said coupling toothing formations; and said spring and said protrusions each having a movement-blocking force sufficiently large in each case to withstand rotary torques between said bodies at least as large as torques for transmitting the adjusting movements and the adjusting forces of the telescopic linkage in said rotation direction.

15. In a household appliance having a manual operating element and a functional part, a telescopic linkage for connecting the manual operating element to the functional part, the telescopic linkage comprising:

at least two longitudinal telescopic bodies including a first body and a second body each having a linkage end, said bodies defining a longitudinal linkage direction;

said first body at least partially inserted inside said second body in said longitudinal linkage direction and rotatable in said second body at least in a rotation direction;

said bodies transmitting adjusting movements and adjusting forces from said linkage end of said first body to said linkage end of said second body in said longitudinal linkage direction and around said longitudinal linkage direction in said rotation direction;

said bodies displaceable relative to one another in said longitudinal linkage direction and arrestable with one another for joint longitudinal movement;

said bodies rotatable relative to one another through an angle-of-rotation range about said longitudinal linkage axis between:

an axially arrested position in which said bodies are axially arrested with respect to one another; and an axially released position in which said bodies are axially moveable with respect to one another; and due to the relative rotation, said bodies, at least in said axially arrested position, being additionally arrestable relative to one another in said rotation direction and releaseable from one another by rotation in a direction opposite said rotation direction.

16. The household appliance according to claim 15, wherein the appliance has:

a cooking point with a gas faucet;

an ignition safety device; and said telescopic linkage actuates the ignition safety device through the operating element in said longitudinal linkage direction and in said rotation direction.

17. A telescopic linkage, comprising:

at least two longitudinal telescopic bodies including a first body and a second body each having a linkage end, said bodies defining a longitudinal linkage direction;

said first body at least partially inserted inside said second body in said longitudinal linkage direction and rotatable in said second body at least in a rotation direction;

said bodies transmitting adjusting movements and adjusting forces from said linkage end of said first body to said linkage end of said second body in said longitudinal linkage direction and around said longitudinal linkage direction in said rotation direction;

said bodies displaceable relative to one another in said longitudinal linkage direction and arrestable with one another for joint longitudinal movement;

said bodies rotatable relative to one another through an angle-of-rotation range about said longitudinal linkage axis between:

an axially arrested position in which said bodies are axially arrested with respect to one another; and an axially released position in which said bodies are axially moveable with respect to one another; and due to the relative rotation, said bodies, at least in said axially arrested position, being additionally arrestable relative to one another in said rotation direction and releaseable from one another by rotation in a direction opposite said rotation direction.

* * * * *